United States Patent [19]

Reisner

[11] 4,307,540

[45] Dec. 29, 1981

[54] DISPLAY HOLDER FOR A PLURALITY OF CHRISTMAS TREES

[76] Inventor: Clarence H. Reisner, 2877 N. Baker St., Bakersfield, Calif. 93302

[21] Appl. No.: 123,146

[22] Filed: Feb. 21, 1980

[51] Int. Cl.[3] ..... A47G 7/02

[52] U.S. Cl. ..... 47/40.5; 248/121; 248/156; 47/43

[58] Field of Search ..... 248/121, 156; 47/42–43, 40.5, 45, 47

[56] References Cited

U.S. PATENT DOCUMENTS

| | | | |
|---|---|---|---|
| 1,536,678 | 5/1925 | Markowski | 47/47 |
| 2,124,049 | 7/1938 | Battista et al. | 47/47 |
| 2,345,455 | 3/1944 | Brumfield | 47/47 |
| 2,349,110 | 5/1944 | Potstada | 47/47 |
| 3,076,557 | 2/1963 | Husted et al. | 248/156 X |
| 3,437,296 | 4/1969 | Hinz | 47/40.5 X |

*Primary Examiner*—Robert E. Bagwill
*Attorney, Agent, or Firm*—Whann & McManigal

[57] ABSTRACT

A merchandising and display holder for releaseably supporting a plurality of Christmas trees, including a main central supporting post with a plurality of hinged radially extending vertically swingable holding arms which are carried by a vertically adjustable bracket on the supporting post. The outer end of each arm is provided with a tree trunk receiving fork arranged with a hook which enables a rubber band or other suitable tie member to releaseably retain the tree trunk in the fork in an upstanding display position. The butt end of each tree trunk may be supported directly on the ground or, if desired, placed in a water container. The main post is arranged to be supported by a base structure which includes a stake arranged to be driven into the ground at a desired display location.

4 Claims, 5 Drawing Figures

DISPLAY HOLDER FOR A PLURALITY OF CHRISTMAS TREES

PRIOR ART

In the prior art, there are numerous holders for individual Christmas trees, and which are clampingly engageable with the tree trunk and also adjustable to accommodate trees of different sizes. Holders for supporting a plurality of trees for commercial merchandising use are found less frequently. The closest art known to applicant are the following U.S. Pat. Nos.

1,463,734—July 31, 1923
2,500,215—Mar. 14, 1950
2,904,292—Sept. 15, 1959
3,119,585—Jan. 28, 1964
3,966,153—June 29, 1976

BACKGROUND OF THE INVENTION

The present invention relates generally to a holder for the commercial display of Christmas trees in spaced apart standing relation, and which permits ease of inspection of each tree by prospective purchasers, and facilitates removal of each tree as sold, and replacement by another tree.

It has heretofore been known in the prior art to provide a variety of individual type holders for Christmas trees, which are of relatively complex and expensive design, and while these holders may meet the needs of an individual for home use, such holders would indeed be too expensive and uneconomical for the commercial display and marketing of a considerable number of Christmas trees.

It has also heretofore been suggested in U.S. Pat. No. 3,966,153 to provide a holding structure which is susceptible of use for the commercial marketing display of a plurality of Christmas trees. The disclosed structure according to this patent utilizes horizontally disposed lumber framing members joined by pairs of specially formed brackets which interconnect the framing members at corner intersections thereof, the lower bracket of each pair having an upstruck fastener for impalement of the tree butt and the upper bracket having an upwardly open slot to receive and interengage a broad-headed nail, or the like, preset in the side of the tree trunk near the butt. The structure of this patent has the obvious undesirable disadvantage in that the framing structure constitutes a potential danger to the purchasing public, who could accidentally stumble or trip over the framing and be injured.

In the present invention, it is proposed to provide a single holder structure by means of which a plurality of Christmas trees may be supported in spaced standing positions in a manner enabling inspection by prospective purchaser on all sides of the tree, and which is of a construction such that the usual wooden supporting bases, as usually provided for each tree, may be eliminated. In a holder according to the present invention, it is an important consideration that the walking area around each displayed tree is free of obstacles and parts of the tree supporting holder that might provide a potential hazard to the health and safety of a prospective purchaser while inspecting a tree. Another important consideration in the present invention is that the elevated arm for supporting each tree is hinged to a main central post, and, when not being utilized to support a tree, is foldable to an out-of-the-way position in which it will not interfere with the prospective purchaser's inspection of the other supported trees.

SUMMARY OF THE INVENTION

It is one object of the herein disclosed invention to provide an improved holder for the display of a plurality of Christmas trees in standing upright spaced positions, in a manner to enable inspection of the trees on all sides by a prospective purchaser.

A further object is to provide a holder for commercially displaying and marketing a plurality of Christmas trees, in which each tree is engaged by an elevated holding arm, and wherein the area surrounding the butt of each tree is free of structural parts or obstacles which could form a potentially dangerous hazard to prospective purchasers while inspecting the trees.

A further object is to provide a holder for the display of a plurality of Christmas trees in which the trees are respectively supported in standing, spaced display positions by elevated radial arms which are hingedly attached to a central post, the arms when not in use being foldable to an out-of-the-way position in which they will not interfere with the inspection of adjacently supported trees.

Another object is to provide a merchandising display holder for a plurality of Christmas trees in which the trees are engaged by holding arms radiating from a central post, and wherein the arms are connected to the central post by means enabling vertical adjustment thereon to vary the elevation of the arms to accommodate trees of different heights.

Still another object is to provide a merchandising display holder for a plurality of Christmas trees, which utilizes a single centrally positioned post structure that includes base means incorporating a stake member adapted to be driven into the ground at any desired display location.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figure 1:
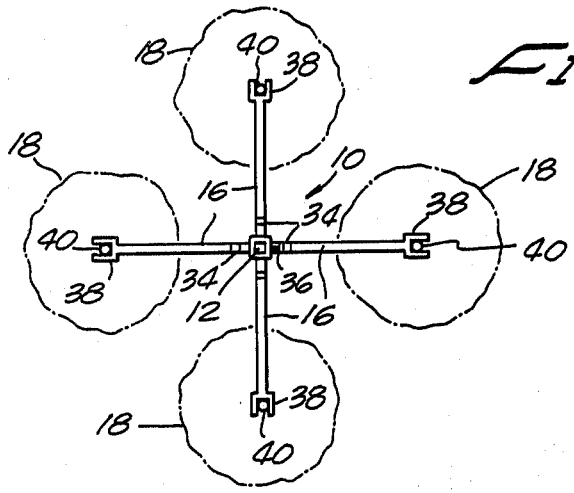
FIG. 1 is a top plan view of a Christmas tree holder according to the present invention, and showing the spaced apart relationship of the plurality of supported trees.

Referring more specifically to the drawings, for illustrative purposes, there is disclosed in FIG. 1 a Christmas tree holder, as generally indicated by the numeral 10, which embodies the features of the present invention. The Christmas tree holder is fabricated to provide a unitary structural assembly in which a central post 12 is supported in an upright position in a ground engaging base structure 14 at its lowermost end. A plurality of radiating holding arms 16 are arranged to support in each case a Christmas tree 18 in spaced apart standing positions so that they may be fully inspected on all sides by a prospective purchaser.

Figure 2:
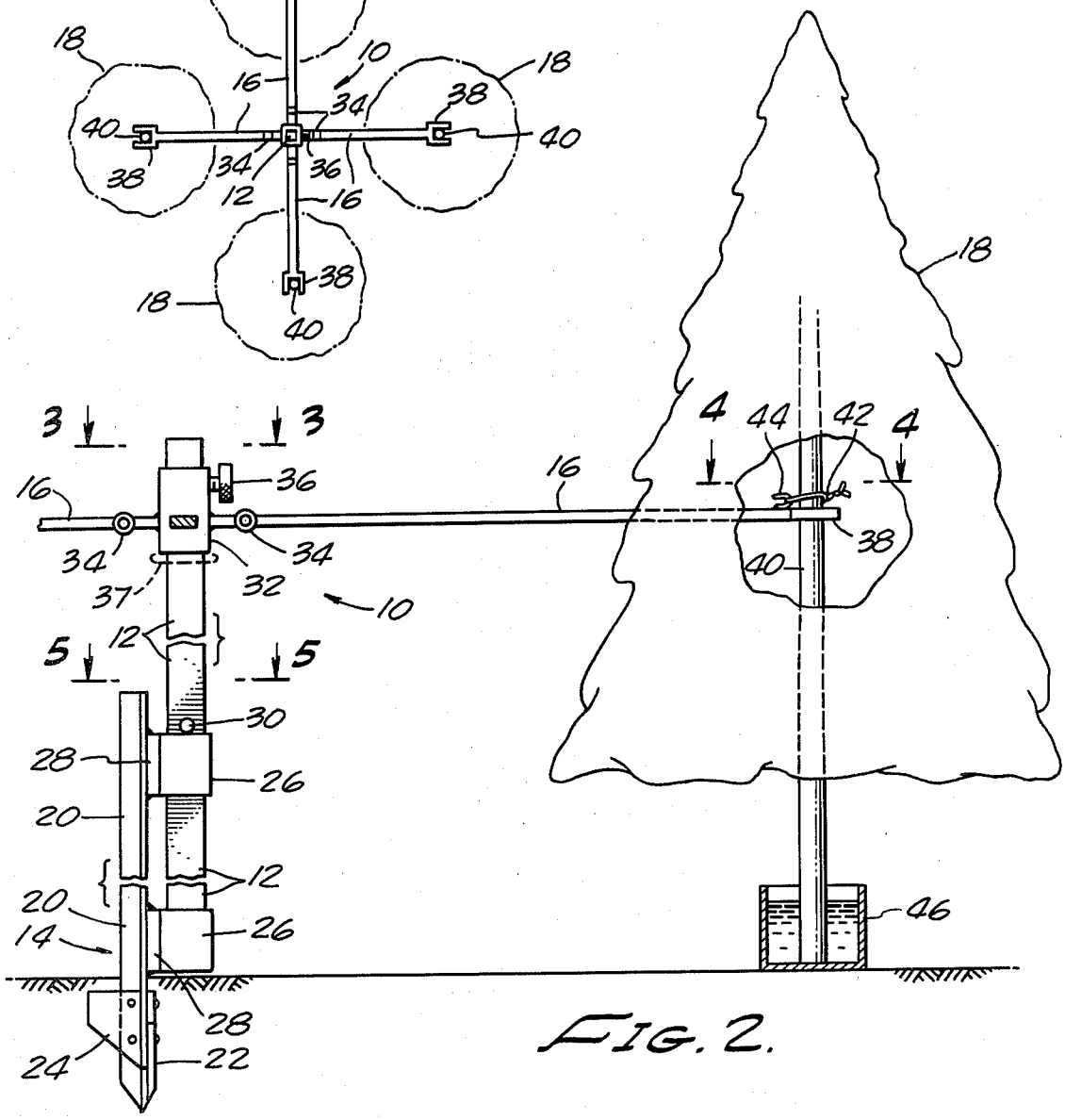
FIG. 2 is an enlarged fragmentary side elevational view showing the manner in which the central post is anchored, and each of the holding arms is attached to a Christmas tree.
Figure 3:
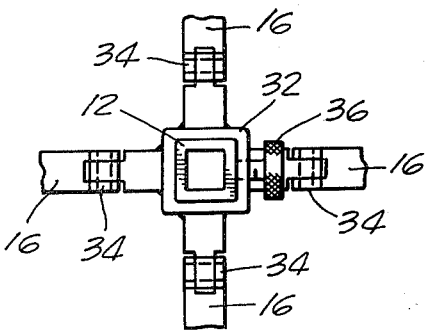
FIG. 3 is an enlarged transverse sectional view, taken substantially on line 3—3 of FIG. 2, and showing the means for adjusting the elevation of the holding arms.
Figure 4:
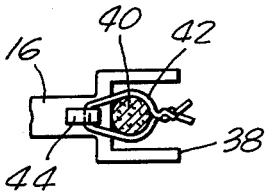
FIG. 4 is an enlarged transverse sectional view, taken substantially on line 4—4 of FIG. 2, showing the manner in which the outermost end of a holding arm is attached to the trunk of the associated Christmas tree.
Figure 5:
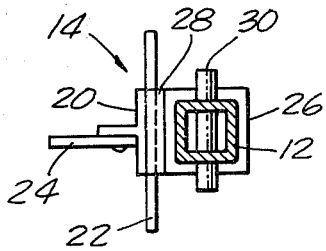
FIG. 5 is an enlarged fragmentary transverse sectional view, taken substantially on line 5—5 of FIG. 2, showing details of the base structure for the central post.

Referring more specifically to FIG. 2, the central post is preferably comprised of a tubular member of a rectangular cross-section, and at its lowermost end is arranged to be releaseably supported by a suitable base structure.

As will be seen, a preferred base structure 14 comprises an elongate stake member 20 of T-cross-section. The lowermost end of the member 20 is sharpened so as to facilitate its being driven into the ground. The member 20 is stabilized against tilting by means of pointed plate members 22 and 24 which are secured to the lowermost end of the stake by suitable rivets or other means in positions with their pointed ends downwardly disposed. The stake 20 mounts a pair of vertically spaced sleeves 26 which are fixedly secured as by welding or otherwise, a spacer plate 28 being interposed between each of the sleeves and the adjacent portion of the stake. A suitable means may be provided to limit the downward movement of the inserted end of the central post 12 within the sleeves 26. For example, a stop pin 30 may be provided on the end of the central post 12. However, this pin may be omitted, if desired, and in such case the downward movement of the post 12 would be terminated by engagement of its lower end against the underlying ground surface.

Preferably, each of the holding arms 16 is formed as an elongate flat bar which is mounted to a sleeve member 32 by means of a suitable hinge 34, the sleeve member 32 being of tubular configuration and slideably movable along the central post 12 which it surrounds. The elevation of the holding arms may be varied by raising and lowering the position of the sleeve member 32 on the central post 12. Provision is also made for releaseably securing the sleeve member 32 at a desired elevated position by means of a clamping screw 36. If desired, the clamping screw 36, may be omitted, and in this case an elastic ring 37, as shown in dotted lines, may be utilized to grippingly engage the post 12 under the sleeve 32 so as to hold it in an adjusted position on the post.

The outermost end of each holding arm 16 is provided with a generally U-shaped fork 38 which is adapted to receive a Christmas tree trunk 40 into a seated position in which it may be releaseably retained by means of an appropriate tie member 42, or rubberband, which may be passed around the trunk and anchored by an adjacent hook 44 or other suitable means adjacent the inner end of the fork. Preferably, the holding arm 16 should be positioned at substantially $\frac{1}{3}$ of the overall height of the tree from the ground.

The butt end of each displayed Christmas tree may be simply engaged with the ground surface. However, if desired, the butt end of the tree trunk may be disposed in a suitable bucket or container 46 which may be filled with water, damp earth or other medium to prolong the life of the tree, while it is being displayed.

From the foregoing description, it will be apparent that the Christmas tree holder as described accomplishes the stipulated objects set forth for the invention.

Various modifications may suggest themselves to those skilled in the art without departing from the spirit of my invention, and, hence, I do not wish to be restricted to the specific form shown or uses mentioned, except to the extent indicated in the appended claims.

I claim:

1. A portable holder for supporting a plurality of cut Christmas trees in an upright position at a desired display location, comprising:

a ground engageable central post structure adapted to be placed in an upstanding position at the display location;

a plurality of elevated radiating arms carried by said post structure;

means at the outer end of each of said arms for releaseably engaging the trunk of a cut tree to locate and hold it in an upright position adjacent to the post structure, and in which position it may be inspected fully on all sides by a prospective purchaser; and means receiving the cut butt end of the tree trunk.

2. A tree holder according to claim 1, in which:

said receiving means comprises a container.

3. A portable holder for supporting a plurality of cut Christmas trees in an upright position at a desired display location, comprising:

a ground engageable central post structure adapted to be placed in an upstanding position at the display location;

a plurality of elevated radiating arms carried by said post structure; means including a trunk receiving fork at the outer end of each of said arms for releaseably engaging the trunk of a cut tree to locate and hold it in an upright position extending upwardly from the ground adjacent to the post structure, and in which position it may be inspected fully on all sides by a prospective purchaser; and means for releasably retaining the trunk in a seated position within the fork including an associated member for anchoring a tie member adapted to extend around the tree trunk.

4. A tree holder according to claim 3, in which:

the anchoring member is a hook.

* * * * *